US006540851B2

(12) United States Patent
Huber, Jr. et al.

(10) Patent No.: US 6,540,851 B2
(45) Date of Patent: Apr. 1, 2003

(54) TANTALUM-SILICON ALLOYS AND PRODUCTS CONTAINING THE SAME AND PROCESSES OF MAKING THE SAME

(75) Inventors: Louis E. Huber, Jr., Allentown, PA (US); Christopher A. Michaluk, Gilbertsville, PA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 09/922,049

(22) Filed: Aug. 3, 2001

(65) Prior Publication Data

US 2002/0011290 A1 Jan. 31, 2002

Related U.S. Application Data

(62) Division of application No. 09/314,506, filed on May 19, 1999.

(60) Provisional application No. 60/086,385, filed on May 22, 1998.

(51) Int. Cl.[7] ..... C22F 3/00

(52) U.S. Cl. ..... 148/538; 148/565; 148/668; 148/422

(58) Field of Search ..... 148/242, 513, 148/514, 538, 565, 668, 422; 420/427

(56) References Cited

U.S. PATENT DOCUMENTS

| | | | | |
|---|---|---|---|---|
| 3,166,414 A | | 1/1965 | France et al. | 750/174 |
| 3,597,192 A | | 8/1971 | Wilhelm et al. | 75/84 |
| 3,790,913 A | | 2/1974 | Peters et al. | 338/308 |
| 3,933,474 A | * | 1/1976 | Ham et al. | 75/10.23 |
| 4,062,679 A | | 12/1977 | Marsh et al. | 753/245 |
| 4,063,211 A | | 12/1977 | Yasujima et al. | 338/308 |
| 4,073,971 A | | 2/1978 | Yasujima et al. | 427/103 |
| 4,128,421 A | | 12/1978 | Marsh et al. | 75/251 |
| 4,235,629 A | | 11/1980 | Marsh et al. | 75/211 |
| 4,394,352 A | | 7/1983 | Helda et al. | 422/232 |
| 4,680,612 A | | 7/1987 | Hieber et al. | 357/71 |
| 4,683,642 A | | 8/1987 | Calviello | 437/40 |
| 4,707,723 A | | 11/1987 | Okamoto et al. | 357/67 |
| 4,859,257 A | | 8/1989 | Bates et al. | 148/422 |
| 5,171,379 A | | 12/1992 | Kumar et al. | 148/422 |
| 5,242,653 A | | 9/1993 | Stern et al. | 204/241 |
| 5,247,198 A | | 9/1993 | Homma et al. | 257/371 |
| 5,286,669 A | | 2/1994 | Maeda et al. | 437/53 |
| 5,411,611 A | | 5/1995 | Kumar et al. | 148/557 |
| 5,474,945 A | | 12/1995 | Yamazaki et al. | 437/41 |
| 5,545,571 A | | 8/1996 | Yamazaki et al. | 437/21 |
| 5,576,225 A | | 11/1996 | Zhang et al. | 437/21 |

FOREIGN PATENT DOCUMENTS

| | | | |
|---|---|---|---|
| CA | 883221 | 10/1971 | 75/38 |
| GB | 6051 | 7/1908 | |
| GB | 2 185 756 A | 7/1987 | |
| WO | WO 91/19015 | 12/1991 | |
| WO | WO 92/20828 | 11/1992 | |

OTHER PUBLICATIONS

Chemical Abstracts, vol. 75, 1971, pp. 104 (78713c).
Chemical Abstracts, vol. 105, 1986, pp. 256 (64658q).
Erdman, "Diversity Penetrates the Refractory Metals Niche" *Metal Producing,* Jul. 1992, pp. 1–4.
Kumar, et al. "Effect of Intermetallic Compounds on the Properties of Tantalum" Mat. Res. Soc. Symp. Proc. vol. 322 (1994), pp. 413–422.
National Research Corporation, Metals Division Research Sheet. pp. 1–7. (No. date).
National Research Corporation Press Release. "New Form of Tantalum", (1964) pp. 1–4.
Miller, "Tantalum and Niobium", Academic Press, Inc., New York, pp. 44–49 and 318–325, 1959.

* cited by examiner

*Primary Examiner*—John P. Sheehan
*Assistant Examiner*—Andrew L. Oltmans

(57) ABSTRACT

An alloy comprising tantalum and silicon is described. The tantalum is the predominant metal present. The alloy also has a uniformity of tensile strength when formed into a wire, such that the maximum population standard deviation of tensile strength for the wire is about 3 KSI for an unannealed wire at finish diameter and about 2 KSI for an annealed wire at finish diameter. Also described is a process of making a Ta—Si alloy which includes reducing a silicon-containing solid and a tantalum-containing solid into a liquid state and mixing the liquids to form a liquid blend and forming a solid alloy from the liquid blend. Another process of making a Ta—Si alloy is described which involves blending powders containing tantalum or an oxide thereof with powders containing silicon or a silicon-containing compound to form a blend and then reducing the blend to a liquid state and forming a solid alloy from the liquid state. Also, a method of increasing the uniformity of tensile strength in tantalum metal, a method of reducing embrittlement of tantalum metal, and a method of imparting a controlled mechanical tensile strength in tantalum metal are described which involve adding silicon to tantalum metal so as to form a Ta—Si alloy.

20 Claims, No Drawings

TANTALUM-SILICON ALLOYS AND PRODUCTS CONTAINING THE SAME AND PROCESSES OF MAKING THE SAME

This application is a divisional of U.S. patent application Ser. No. 09/314,506 filed May 19, 1999. This application is entitled to benefit from the prior U.S. Provisional Patent Application No. 60/086,385 filed May 22, 1998, which is incorporated in its entirety by reference herein.

BACKGROUND OF THE INVENTION

The present invention relates to metal alloys, processes of making the same, and products made from or containing the alloy. More particularly, the present invention relates to alloys containing at least tantalum.

Tantalum has many uses in industry, such as use in capacitor-grade wires, deep-draw quality strips for making crucibles and the like, thin gauge strips, and other conventional uses. In forming products to be used in industry, the tantalum is obtained from tantalum bearing ore and converted to a salt which is then reduced to form a powder. The powder can be processed into an ingot by melting or the powder can be pressed and sintered to form the desired product. While the currently available commercial grades of tantalum has been acceptable to industry, there has been a desire to improve the tantalum properties since a powder metallurgy tantalum bar can have a wide range of different tensile strengths throughout the product and/or the ingot metallurgy tantalum can have large grain sizes which cause unwanted embrittlement of the tantalum, especially when formed into small diameters, as in the case of wire gauges.

Accordingly, there is a desire to improve the consistency of properties of tantalum to overcome the above-described disadvantages.

SUMMARY OF THE INVENTION

In accordance with one aspect of the present invention, the present invention relates to a metal alloy containing at least tantalum and silicon, wherein the tantalum is the highest weight percent metal present in the metal alloy. The alloy preferably has a uniformity of tensile strength when formed into a wire, such that the maximum population standard deviation of tensile strength for the wire is about 3 KSI for an unannealed wire at finish diameter and about 2 KSI for an annealed wire at finish diameter.

The present invention further relates to various products made from the alloy such as bars, tubes, sheets, wire, capacitors, and the like.

The present invention also relates to a process of making a metal alloy containing at least tantalum and silicon, wherein the tantalum is the highest weight percent metal present in the metal alloy. The method includes the steps of blending a first powder containing tantalum or an oxide thereof with a second powder containing at least silicon, an oxide thereof, or a silicon-containing compound to form a blend. This blend is then reduced to a liquid state, such as by melting the blend, and a solid alloy is then formed from the liquid state.

The present invention also relates to another process of making the alloy which includes reducing into a liquid state, either separately or together, a silicon-containing solid and a tantalum-containing solid to form a silicon-containing liquid and tantalum-containing liquid. The two liquids are then mixed together to form a liquid blend and then the liquid blend is formed into a solid alloy.

The present invention, in addition, relates to a method of increasing the uniformity of tensile strength in tantalum metal by silicon doping or introducing silicon to the tantalum metal in a sufficient amount to increase the uniformity of the tensile strength in the tantalum metal.

The present invention further relates to a method of reducing embrittlement of tantalum metal which includes the steps of doping the tantalum metal with silicon or introducing silicon to the tantalum metal in a sufficient amount to reduce the embrittlement of the tantalum metal.

Finally, the present invention relates to a method of imparting a controlled mechanical tensile strength level in tantalum metal by doping the tantalum metal with silicon or introducing silicon to the tantalum metal and then annealing the tantalum metal to impart a controlled or desired mechanical tensile strength in the tantalum metal.

It is to be understood that both the foregoing general description and the following detailed description are exemplary and explanatory only and are intended to provide further explanation of the present invention, as claimed.

DETAILED DESCRIPTION OF THE PRESENT INVENTION

The present invention relates, in part, to a metal alloy ingot comprising at least tantalum and silicon. The tantalum that is part of the metal alloy is the primary metal present. Thus, amongst any metal that may optionally be present, the highest weight percent of any metals present will be tantalum. Preferably, the weight percent of tantalum present in the alloy is at least about 50%, more preferably at least about 75%, even more preferably at least about 85% or at least about 95%, and most preferably at least about 97% or from about 97% to about 99.5% or higher tantalum. In the preferred embodiment, the alloy can be also considered tantalum microalloyed with silicon. The silicon is present in low amounts. Preferably, the tantalum-silicon alloy (or Ta—Si alloy) comprises from about 50 ppm by weight to about 5% by weight elemental silicon, more preferably from about 50 ppm to about 1,000 ppm elemental silicon, and most preferably from about 50 ppm to about 300 ppm elemental silicon, based on the weight of the alloy. The alloy preferably has less than 1% by weight elemental silicon present. The amount of silicon present in the alloy is generally a sufficient amount to increase the uniformity of the tensile strength of the resulting alloy compared to a tantalum metal containing no silicon.

The alloy of the present invention can contain other additional ingredients such as other metals or ingredients typically added to tantalum metal, such as yttrium, zirconium, titanium, or mixtures thereof. The types and amounts of these additional ingredients can be the same as those used with conventional tantalum and would be known to those skilled in the art. In one embodiment, the yttrium present in the alloy is less than 400 ppm or less than 100 ppm or less than 50 ppm. Metals other than tantalun can be present and preferably comprise less than 10% by weight in the alloy, more preferably less than 4% by weight in the alloy, and even more preferably less than 3%, or less than 2% by weight of alloy. Also, preferably, no or substantially no tungsten or molybdenum are present in the alloy.

Also, the alloy preferably has low levels of nitrogen present, such as less than 200 ppm and preferably less than 50 ppm, and even more preferably less than 25 ppm and most preferably less than 10 ppm. The alloy can also have low levels of oxygen present in the alloy, such as less than 150 ppm, and preferably less than 100 ppm, and more preferably less than about 75 ppm and even more preferably less than about 50 ppm.

The alloys of the present invention generally can have any grain size including the grain size typically found in pure or substantially pure tantalum metal. Preferably, the alloy has a grain size of from about 75 mircons to about 210 microns and more preferably from about 75 microns to about 125 microns when heated at 1800° C. for 30 minutes. Also, preferably, the alloy can have a grain size of from about 19 microns to about 27 microns when heated at 1530° C. for 2 hours.

The alloy preferably has a uniformity of tensile strength when formed into a wire, such that the maximum population standard deviation of tensile strength for the wire is about 3 KSI, more preferably about 2.5 KSI, even more preferably about 2.0 KSI, and most preferably about 1.5 KSI or 1.0 KSI for an unannealed wire at finish diameter. The alloy also preferably has a maximum population standard deviation of tensile strength for the wire of about 2 KSI, more preferably about 1.5 KSI, and even more preferably about 1.0 KSI, and most preferably about 0.5 KSI for an annealed wire at finish diameter.

The alloys of the present invention can be made in a number of ways. In a preferred method, a first powder comprising tantalum or an oxide thereof (e.g., tantalum containing solid) is blended with a second powder comprising silicon or a silicon-containing compound.

For purposes of the present invention, a silicon-containing solid is any solid which can subsequently be reduced to a liquid state to impart elemental silicon in a tantalum metal. Examples of silicon-containing compounds include, but are not limited to, elemental silicon powder, $SiO_2$, glass beads, and the like. Further, a tantalum-containing solid is any solid material containing at least tantalum which can be reduced into a liquid state to form a tantalum metal. An example of a tantalum-containing solid would be tantalum powder or tantalum scrap and the like.

After the powders are blended to form a blend, the blend is then reduced to a liquid state, such as by melting. The manner in which the blend is reduced to a liquid state, such as by melting, can be accomplished by any means. For instance, the melting can be accomplished by electron-beam melting, vacuum arc remelt processing, or plasma melting.

Once the blend has been reduced to a liquid state, the liquid blend can then be allowed to form into or return to a solid state and form a solid alloy by any means including chilling in a crucible, such as a water-cooled copper crucible, or atomizing (e.g., gas or liquid atomizing), rapid solidification processes, and the like.

In this process, generally any amount of silicon-containing compound or elemental silicon can be used or introduced to the tantalum metal as long as the amount will still result in a tantalum based alloy being formed. Preferably, the powder blend, once formed, contains from about 0.01% by weight to about 25% by weight, more preferably from about 0.5% by weight to about 2.0% by weight, and most preferably from about 0.80% by weight to about 1.2% by weight elemental silicon, based on the weight of the entire blend.

As stated earlier, this blend can further contain other ingredients, additives, or dopants such as those typically used in conventional tantalum metals, like yttrium, zirconium, titanium or mixtures thereof.

In the preferred embodiment of the present invention, the blend is reduced into a liquid state by electron beam melting (in a vacuum) wherein the blend can be melted at any rate including a rate of from about 200 lbs. per hour to about 700 lbs. per hour, using, for instance a 1200 KW Leybold EB furnace which can casts into a 10 to 12 inch ingot. Any size ingot can be made depending on the type of EB furnace and its cooling capability.

Preferably, the alloy subsequently formed is reduced to the liquid state or melted more than one time, and preferably at least two or more times. When melting at least two times, the first melting is preferably at a melt rate of about 400 lbs. per hour and the second melt is preferably at a melt rate of about 700 lbs. per hour. Thus, the alloy, once formed, can be reduced into the liquid state any number of times to further result in a more purified alloy and to assist in reducing the levels of silicon to desired ranges in the final product, since the silicon or silicon-containing compound may be added in excess.

The alloy resulting from the above-described process can contain the amounts of elemental silicon previously described and preferably contains from about 50 ppm to about 5% by weight and more preferably less than 1% by weight elemental silicon based on the weight of the alloy.

Another process of making the alloy of the present invention involves reducing into a liquid state a silicon-containing solid and a tantalum-containing solid. In this process, the silicon-containing solid can be reduced into a liquid se separately and the tantalum-containing solid can be also reduced into a liquid state separately. Then, the two liquid states can be combined together. Alternatively, the silicon-containing solid and tantalum-containing solid can be added together as solids and then subsequently reduced into a liquid state.

Once the silicon-containing solid and tantalum containing solid are reduced to a liquid state such as by melting, the two liquids are then mixed together to form a liquid blend which is subsequently formed into a solid alloy. Like the previously described process, additional ingredients, additives, and/or dopants can be added during the process.

The silicon or silicon-containing compound can alternately be introduced as a gas and "bled" into the melt chamber or crucible.

The present invention also relates to a method of increasing the uniformity of tensile strength in material comprising tantalum metal. As stated earlier, tantalum metal, especially when formed into bars or similar shapes, can have a large variance in mechanical properties such as tensile strength, throughout the length and/or width of the bar. With the alloys of the present invention, the uniformity of tensile strength in the tantalum metal is improved compared to tantalum metal containing no silicon. In other words, the variance or standard deviation of the tensile strength can be reduced in the alloys of the present invention. Accordingly, the uniformity of the tensile strength in tantalum metal can be increased by doping or adding silicon to the tantalum metal in such a manner so as to form a Ta—Si alloy which has an increased or improved uniformity of tensile strength compared to tantalum metal having no silicon present, especially when the tantalum is formed into wire or strips.

The amount of silicon present in the tantalum metal would be the same as discussed earlier. The standard deviation of the tensile strength can be decreased by a number of times using tantalum metal containing silicon. For instance, the standard deviation of the tensile strength can be reduced by about 10 times or more compared to a tantalum metal containing no silicon. Preferably, the standard deviation is reduced at least 10%, more preferably at least 25%, and most preferably at least 50% compared to a tantalum metal having no silicon present.

Similarly, the embrittlement of tantalum metal can be reduced by forming a Ta—Si alloy compared to melted tantalum with no silicon present or powder metallurgy tantalum with no silicon present.

Besides these advantages, the present invention further relates to a method of imparting a controlled mechanical tensile strength level to tantalum metal. In more detail, based on the amount of silicon present in the Ta—Si alloy and the annealing temperature used on the alloy, specific controlled ranges of tensile strength can be imparted to the alloy. For instance, a higher annealing temperature will lead to a lower tensile strength in the alloy. Further, a higher amount of silicon present in the alloy will lead to a higher tensile strength in the alloy. Thus, the present invention permits one to control or "dial in" the particular tensile strength desired in a tantalum metal based on these variables.

The annealing temperature which assists in determining the controlled mechanical tensile strength level in the tantalum metal is preferably the last annealing performed on the Ta—Si alloy. This last annealing of the Ta—Si alloy is the annealing most controlling in determining the particular mechanical tensile strength level in the tantalum metal. Generally, the Ta—Si alloy can be annealed at any temperature which will not result in the melting of the alloy. Preferred annealing temperature ranges (e.g, intermediate or final annealing) are from about 900° C. to about 1600° C., and more preferably from about 1000° C., to about 1400° C., and most preferably from about 1050° C. to about 1300° C. These annealing temperatures are based on annealing for about 1 to about 3 hours, preferably about 2 hours. Thus, if one wanted to obtain a lower tensile strength (e.g., 144.3 KSI), one would intermediate anneal at a temperature of about 1200° C. If a higher tensile strength ( e.g., 162.2 KSI) is desired in the tantalum metal, one would intermediate anneal at a temperature of about 1100° C.

Once the alloy is formed, the Ta—Si alloy can be subjected to any further processing as any conventional tantalum metal. For instance, the alloy can be subjected to forging, drawing, rolling, swaging, extruding, tube reducing, or more than one of these or other processing steps. As indicated earlier, the alloy can be subjected to one or more annealing steps, especially depending on the particular shape or end use of the tantalum metal. The annealing temperatures and times for processing the Ta—Si metal are described above.

The alloy thus can be formed into any shape such as a tube, a bar, a sheet, a wire, a rod, or a deep drawn component, using techniques known to those skilled in the art. The alloy can be used in capacitor and furnace applications and other applications for metals where embrittlement is a consideration.

The present invention will be further clarified by the following examples, which are intended to be purely exemplary of the present invention.

EXAMPLES

A sodium reduced tantalum powder was used and had the following characteristics:

| The ingot had the following impurities (ppm): | | | |
|---|---|---|---|
| Carbon | 10 | Manganese | <5 |
| Oxygen | 80 | Tin | <5 |
| Nitrogen | <10 | Nickel | <5 |
| Hydrogen | <5 | Chromium | <5 |

-continued

| The ingot had the following impurities (ppm): | | | |
|---|---|---|---|
| Niobium | <25 | Sodium | <5 |
| Titanium | <5 | Aluminum | <5 |
| Iron | 15 | Molybdenum | <5 |
| Copper | <5 | Zirconium | <5 |
| Cobalt | <5 | Magnesium | 5 |
| Boron | <5 | Tungsten | <5 |

To this tantalum powder was added 1% by weight Si (in the form of reagent grade elemental silicon powder) based on the weight of the blend. The blended powder was then subjected to an electron beam melt in a Leybold 1200 KW EB furnace using a melt rate of 222.5 lbs/hour. Once the powders were melted, the alloy was allowed to form into a solid and was again remelted in the electron beam using a melt rate of 592.0 lbs/hour. The formed alloy had silicon present ranging from about 120 ppm Si to about 150 ppm Si. The formed alloy were machined and rotary forged to a 4" bar and machined clean. Then this bar was annealed at 1530° C. for two hours. The bar was then subjected to 5 additional intermediate anneals at 1300° C. for two hours while this bar was being rolled and drawn to a 0.2 mm diameter and a 0.25 mm diameter wire wherein a part of each wire was strand annealed at a temperature of from 1500° C. to 1600° C. at three different speeds (35 ft/min, 30 ft/min, and 25 ft/min) while the remaining sample of wire was unannealed. The sample was compared to an unannealed powder metallurgy Ta metal formed in the same manner but with no Si added. The tested wire samples had the following ultimate tensile strength as measured by ASTM E-8.

TABLE 1

| Ultimate Tensile Strength (RSI) | | | |
|---|---|---|---|
| Unannealed Ta | | Ta-Si alloy | |
| Dia | avg. | ZSD range | |
| 0.2 mm | 132 | 122/142 | 130.0 |
| | | | 124.3 |
| | | | 133.8 |
| 0.25 mm | 133 | 123/143 | 120.6 |
| | | | 134.6 |
| | | | 130.4 |

Also, bend test results were conducted on the samples and the alloy wire of the present invention successfully resisted embrittlement through sintering at 1950° C. for 30 minutes.

Example 2

A tantalum and silicon containing powder was prepared and formed into an ingot as in Example 1. The tantalum ingot was electron melted (as in Example 1, except using the melt rate shown in Table 2) into five sections. The silicon amounts indicated in Table 2 below are the amounts of silicon present in the alloy.

TABLE 2

| Section | Melt Stock Base Material | Weight (lb.) | % Si (by wt.) | Planned Melt Rate (lb/hr) |
|---|---|---|---|---|
| 1 | HR | 708 | 1.0 | 400 |
| 2 | HR | 809 | 0.5 | 400 |

TABLE 2-continued

| Section | Melt Stock Base Material | Weight (lb.) | % Si (by wt.) | Planned Melt Rate (lb/hr) |
|---|---|---|---|---|
| 3 | 70% deoxidized colored anodes, plus 30% HR | 497 | 1.0 | 400 |
| 4 | HR | 721 | 1.0 | 200 |
| 5 | HR | 687 | 0.5 | 200 |

The amount of silicon present in the tantalum metal was then determined by emission spectrography. It was discovered that the metal having 0.5 wt. % silicon added resulted in significantly reduced retained Si levels of from about 30 to about 60 ppm and a reduction in Briner Hardness Number (BHN) of 12 points compared to the sample with 1.0 wt. % silicon.

The samples (section 3) having 1.0% silicon added resulted in uniform retained Si levels both on the surface (138–160 ppm) and internally (125–200 ppm). The decreased melt rate samples resulted in a slight increase in Si retention on the surface (135–188 ppm) and internally (125–275 ppm). In each case, the hardness of the alloy was very uniformed exhibiting a average BHN of 114 with a range of 103 to 127.

Example 3

Wire samples were prepared as in Example 1, except the final intermediate annealing temperature was adjusted as shown in Table 3 below. The final intermediate annealing temperature was also for two hours.

TABLE 3

| | | Ultimate Tensile Strength | | |
|---|---|---|---|---|
| Diameter | Intermediate Anneal | Average | Range | Std Dev |
| 0.2 mm (Ta-Si alloy) | 1200° C. | 144.3 | 5.7 | 1.58 |
| 0.2 mm (Ta metal) | 1300° C. | 133.4 | 9.3 | 5.94 |
| 0.25 mm (Ta-Si alloy) | 1100° C. | 162.2 | 1.3 | 0.54 |
| 0.25 mm (Ta metal) | 1300° C. | 135.8 | 9.0 | 4.73 |

As can be seen from the results in Table 3, the Ta—Si alloy had a much lower standard deviation in tensile strength. Also, the variance in annealing temperature shows the ability to control the tensile strength range.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process of making an alloy comprising tantalum and silicon comprising:

blending a first powder comprising tantalum or an oxide thereof with a second powder comprising silicon or a silicon-containing compound to form a blend;

reducing said blend into a liquid state by melting;

forming a solid alloy from said liquid state, wherein said melting is electron beam melting.

2. The process of claim 1, wherein said blend comprises from about 0.01% by weight to about 25% by weight elemental silicon.

3. The process of claim 1, wherein said blend comprises from about 0.5% by weight to about 2.0% by weight elemental silicon.

4. The process of claim 1, wherein said blend comprises from about 0.80% by weight to about 1.2% by weight elemental silicon.

5. The process of claim 1, wherein said blend further comprises yttrium, zirconium, titanium, or mixtures thereof.

6. The process of claim 1, wherein said reducing of blend into a liquid state comprises melting said blend.

7. The process of claim 1, further comprising reducing said solid alloy into a liquid state and re-forming into said solid alloy.

8. The process of claim 1, further comprising subjecting said solid alloy to forging, drawing, rolling, swaging, extruding, tube reducing or combinations thereof.

9. The process of claim 1, further comprising annealing said solid alloy.

10. The process of claim 1, wherein said solid alloy comprises from about 50 ppm to about 5% by weight elemental silicon.

11. A process of making an alloy comprising tantalum and silicon comprising:

reducing into a liquid state, separately or together, a silicon-containing solid and a tantalum-containing solid to form a silicon-containing and tantalum containing liquid;

mixing the silicon-containing liquid and tantalum containing liquid to form a liquid blend; and forming a solid alloy from said liquid blend, wherein said reducing into a liquid state is accomplished by electron beam melting, wherein said blend comprises from about 50 ppm by weight to about 25% by weight elemental silicon.

12. The process of claim 11, wherein said blend comprises from about 0.01% by weight to about 25% by weight elemental silicon.

13. The process of claim 11, wherein said blend comprises from about 0.5% by weight to about 2.0% by weight elemental silicon.

14. The process of claim 11, wherein said blend comprises from about 0.80% by weight to about 1.2% by weight elemental silicon.

15. The process of claim 11, wherein said blend further comprises yttrium, zirconium, titanium, or mixtures thereof.

16. The process of claim 11, wherein said reducing of blend into a liquid state comprises melting said blend.

17. The process of claim 11, further comprising reducing said solid alloy into a liquid state and re-forming into said solid alloy.

18. The process of claim 11, further comprising subjecting said solid alloy to forging, drawing, rolling, swaging, extruding, tube reducing or combinations thereof.

19. The process of claim 11, further comprising annealing said solid alloy.

20. The process of claim 11, wherein said solid alloy comprises from about 50 ppm to about 5% by weight elemental silicon.

* * * * *